US005604972A

United States Patent [19]

McCarrick

[11] Patent Number: 5,604,972

[45] Date of Patent: Feb. 25, 1997

[54] METHOD OF MANUFACTURING A HELICAL ANTENNA

[75] Inventor: Charles D. McCarrick, Plymouth, Mass.

[73] Assignee: AMSC Subsidiary Corporation

[21] Appl. No.: 481,995

[22] Filed: Jun. 7, 1995

Related U.S. Application Data

[62] Division of Ser. No. 58,079, May 10, 1993, Pat. No. 5,485, 170.

[51] Int. Cl.[6] ..... H01P 11/00

[52] U.S. Cl. ..... 29/600; 138/122; 156/175; 343/895

[58] Field of Search ..... 29/600; 138/122, 138/154; 343/895; 156/175

[56] References Cited

U.S. PATENT DOCUMENTS

| | | | |
|---|---|---|---|
| 2,166,589 | 7/1939 | Harrington . | |
| 2,300,847 | 11/1942 | Russel . | |
| 2,688,698 | 9/1954 | Gosline . | |
| 2,966,678 | 12/1960 | Harris . | |
| 2,966,679 | 12/1960 | Harris . | |
| 2,973,481 | 2/1961 | Frye . | |
| 3,495,261 | 2/1970 | Lastinger et al. . | |
| 3,599,126 | 8/1971 | Osifchim | 29/600 X |
| 3,629,937 | 12/1971 | Fredriksson et al. | 29/600 |
| 3,845,549 | 11/1974 | Ferrentino | 29/600 |
| 3,858,220 | 12/1974 | Arnow . | |
| 3,864,648 | 2/1975 | McVickers | 29/600 X |
| 3,940,772 | 2/1976 | Ben-dov . | |
| 4,043,029 | 8/1977 | Allanic et al. | 29/600 |
| 4,071,834 | 1/1978 | Comte | 29/600 X |
| 4,087,820 | 5/1978 | Henderson . | |
| 4,163,981 | 8/1979 | Wilson . | |
| 4,379,298 | 4/1983 | Vincent et al. . | |
| 4,413,451 | 11/1983 | Featherstone et al. . | |
| 4,725,395 | 2/1988 | Gasparaitis | 29/601 X |
| 4,725,843 | 2/1988 | Suzuki et al. . | |
| 4,742,360 | 5/1988 | Carolus et al. . | |
| 4,780,727 | 10/1988 | Seal et al. . | |
| 4,862,184 | 8/1989 | Ploussios | 29/600 X |
| 4,920,354 | 4/1990 | Rauser et al. . | |
| 4,987,424 | 1/1991 | Tamara et al. . | |
| 5,077,560 | 12/1991 | Horton et al. . | |
| 5,134,422 | 7/1992 | Auriol . | |
| 5,146,235 | 9/1992 | Frese . | |
| 5,170,176 | 12/1992 | Yasunuga et al. . | |
| 5,191,352 | 3/1993 | Branson . | |
| 5,300,940 | 4/1994 | Simmon . | |
| 5,341,149 | 8/1994 | Valimaa | 29/600 X |
| 5,396,698 | 3/1995 | Orthmann et al. | 29/600 |

*Primary Examiner*—Carl J. Arbes
*Attorney, Agent, or Firm*—Lowe, Price, LeBlanc & Becker

[57] ABSTRACT

A mobile vehicular antenna for use in accessing stationary geosynchronous and/or geostable satellites. A multi-turn quadrifilar helix antenna is fed in phase rotation at its base and is provided with a pitch and/or diameter adjustment for the helix elements, causing beam scanning in the elevation plane while remaining relatively omni-directional in azimuth. The antenna diameter and helical pitch are optimized to reduce the frequency scanning effect. A technique is provided for aiming the antenna to compensate for any remaining frequency scanning effect.

24 Claims, 8 Drawing Sheets

METHOD OF MANUFACTURING A HELICAL ANTENNA

This application is a division of application Ser. No. 08/058,079 filed May 10, 1993, now U.S. Pat. No. 5,485,170 issued Jan. 16, 1996.

TECHNICAL FIELD

The present invention relates to radio transceiver antennas, more particularly mobile vehicular antennas for use in accessing stationary geosynchronous and/or geostable satellites.

BACKGROUND ART

Mobile communications systems are known in the art for providing a communications link between a mobile vehicle (e.g., automobile, truck, train, airplane or the like) and stationary base or another mobile vehicle. Communications link, as used in the present application is defined, but not limited to voice, data, facsimile or video transmission or the like. Some such known systems utilize local radio transmitters and receivers, for example, various radio dispatched vehicles (taxis, police, deliveries, repair services, or the like) ham or amateur radio, Citizens Band Radio (CB), commercial transmitters, cellular systems or the like.

The disadvantage of these local radio frequency devices is that they provide only a limited scope of coverage. Practical limitations in transmitter and receiver design as well as bandwidth considerations limit the range of such systems. For some applications, for example, commercial transportation (e.g., shipping; common carriers and the like) it is desirable to provide communications coverage for a larger area, such as the continental United States (CONUS). Such coverage is possible with a series of local transmitter stations strategically located throughout the CONUS area, however, the practical limitations of maintaining and operating such a large number of transmitting stations renders such a system too costly and impractical. Further, even if such a system were implemented, coverage over the entire CONUS could not be assured, as "blackout" areas could arise due to local terrain and weather conditions.

As such, it has been proposed to provide a Mobile Satellite Communications system (MSAT) for use in providing a communications link between one or more stationary bases and mobile vehicles, or between stationary bases or between mobile vehicles. Satellite communications systems are known in the art and have been extensively used in the telecommunications and television arts. For example, a satellite can be placed in a geosynchronous and/or geostable orbit with a broadcast "footprint" which covers the entire CONUS. Of course, other "footprint" sizes could also be used to cover other geographic areas. Further, multiple satellites could also be used to provide a plurality of "footprints" (overlapping or not) to cover a particular area or areas.

The use of a satellite system overcomes many of the disadvantages of local radio frequency networks. For example, it is possible, with a satellite system, to use one satellite transponder to provide a common data link with a plurality of vehicles or sites throughout the CONUS. The use of new, so-called "high power" satellite transponders in higher frequency bands (e.g., Ku-band, L-band and the like) makes possible a more robust, stronger signal which can be more readily received throughout the entire CONUS.

Such a strong signal is desirable in mobile applications in particular as constraints are placed on antenna design. For example, in early telecommunications and television applications, so called "low" power satellite transponders (on-the order of tens of watts) provided a fairly weak signal which generally required a fairly large antenna to receive. Typical terrestrial antennas were parabolic designs (or variants thereof) on the order of at least a meter or more in diameter, utilizing low noise amplifiers to amplify the relatively weak received signal.

For mobile applications, a more compact, relatively omnidirectional antenna is desirable. Aerodynamic and aesthetic requirements necessitate that the antenna design be small and relatively short. Further, the antenna must also be robust in order to survive in a mobile (e.g., automotive) environment. In addition, if such a system is to be widely adopted, the antenna design must be relatively inexpensive in order to keep the overall cost of the mobile transceiver down. Since the communications link between the satellite and the antenna is more or less a line of sight transmission link and since a mobile vehicle is rarely positioned in one location for any given period of time, an efficient, relatively omnidirectional antenna is needed.

Thus, prior art parabolic antenna designs are impractical for mobile use. Such antennas are relatively large and expensive and largely unidirectional. For mobile applications, an antenna positioning device would be needed to constantly reposition the antenna for optimum reception. Furthermore, such an antenna design would be much too bulky for mobile application, presenting too large a surface for aerodynamic considerations, and presenting a generally displeasing aesthetic appearance. Moreover, in mobile applications, such an antenna design would be too delicate to survive long. Low hanging branches, parking garages and other aerial hazards would quickly destroy such a large antenna.

An example of one such mobile parabolic dish design is shown in Suzuki et al. U.S. Pat. No. 4,725,843, issued Feb. 16, 1988 shown in FIG. 1. FIG. 1 shows a vehicle 3 with parabolic dish antenna 1 and feed horn 2. As can be readily ascertained from FIG. 1, the relatively large dish antenna 1 precludes the use of any rooftop accessories (e.g., roof rack or the like) and presents quite a profile to the wind. In addition, such a design is somewhat aesthetically displeasing, thus precluding mass consumer acceptance. Such mobile satellite communications systems have consumer applications and as such, a pleasing aesthetic design is a necessary criteria. The parabolic dish 1 of FIG. 1 also requires a positioning mechanism to constantly reposition dish 1 as vehicle 3 travels. Such a positioning system is complex and fragile, adding to the cost and maintenance of the unit and detracting from the reliability and robustness of the design. Finally it is noticeable that the design of FIG. 1 is particularly susceptible to damage due to low clearances such as garages and the like.

A practical MSAT antenna must also be able to compensate for changes in latitude. In particular, as a vehicle travels from areas of high latitude (e.g., Northern CONUS) to areas of lower latitude (e.g., Southern CONUS), the angle of elevation between the vehicle and the satellite changes (e.g., from 20° to 60°). Thus it remains a requirement to provide an antenna which, although maintaining relatively omnidirectional coverage in the azimuth, is capable of scanning its main radiation beam in elevation to compensation for changes in latitude.

For applications in which it is desirable to provide both transmit and receive capabilities in the mobile unit, the antenna must also be able to efficiently transmit radio signals to the satellite and receive return signals as well. In typical radio communications systems, different frequencies are chosen for the transmit and receive signals in order to prevent interference between these two signals. Unfortunately, most antenna designs are optimized for one frequency or a range or band of frequencies. As with all travelling wave antennas, the location of the peak radiation beam varies with frequency, giving rise to a phenomenon called "frequency scanning". This phenomena results in an unfortunate reduction in antenna gain between the transmit and receiving modes of operation. This reduction in gain is sometimes called "cross-over loss".

Thus, it remains a requirement in the art to provide a small, inexpensive, efficient vehicular MSAT antenna which has relatively omni-directional coverage in azimuth. It remains a further requirement in the art to provide an MSAT antenna which has an aesthetically pleasing and robust design. It remains a further requirement in the art to provide an MSAT antenna which is capable of scanning its main radiation beam in elevation while remaining relatively omni-directional in azimuth. It remains an even further requirement in the art to provide a vehicular MSAT antenna with reduced frequency scanning.

The present invention solves these and other problems by providing a multi-turn quadrifilar helix antenna fed in phase rotation at its base. The antenna of the present invention provides for an adjustment of the helix elements, causing beam scanning in the elevation plane. The quadrifilar helical antenna is omni-directional in azimuth, making the antenna particularly suitable for a mobile vehicular antenna accessing stationary satellites.

OBJECTS OF THE INVENTION

Thus, it is an object of the present invention to provide an MSAT antenna which is reduced in size.

It is a further object of the present invention to provide an MSAT antenna which is inexpensive to produce.

It is a further object of the present invention to provide an MSAT antenna which efficiently transmits and receives radio frequency signals.

It is a further object of the present invention to provide an MSAT antenna which has relatively omni-directional coverage in azimuth.

It is a further object of the present invention to provide an MSAT antenna with a robust design capable of withstanding a vehicular environment.

It is a further object of the present invention to provide an MSAT antenna which is capable of scanning its main radiation beam in elevation while remaining relatively omni-directional in azimuth.

It is a further object of the present invention to provide a vehicular MSAT antenna with reduced frequency scanning characteristics.

DISCLOSURE OF THE INVENTION

The MSAT antenna of the present invention comprises a multi-turn helix antenna having at two elements fed in anti-phase or three or more elements fed phase rotation at its base. The antenna of the present invention provides for an adjustment of the helix elements, causing beam scanning in the elevation plane.

BEST MODE FOR CARRYING OUT THE INVENTION

Figure 1:
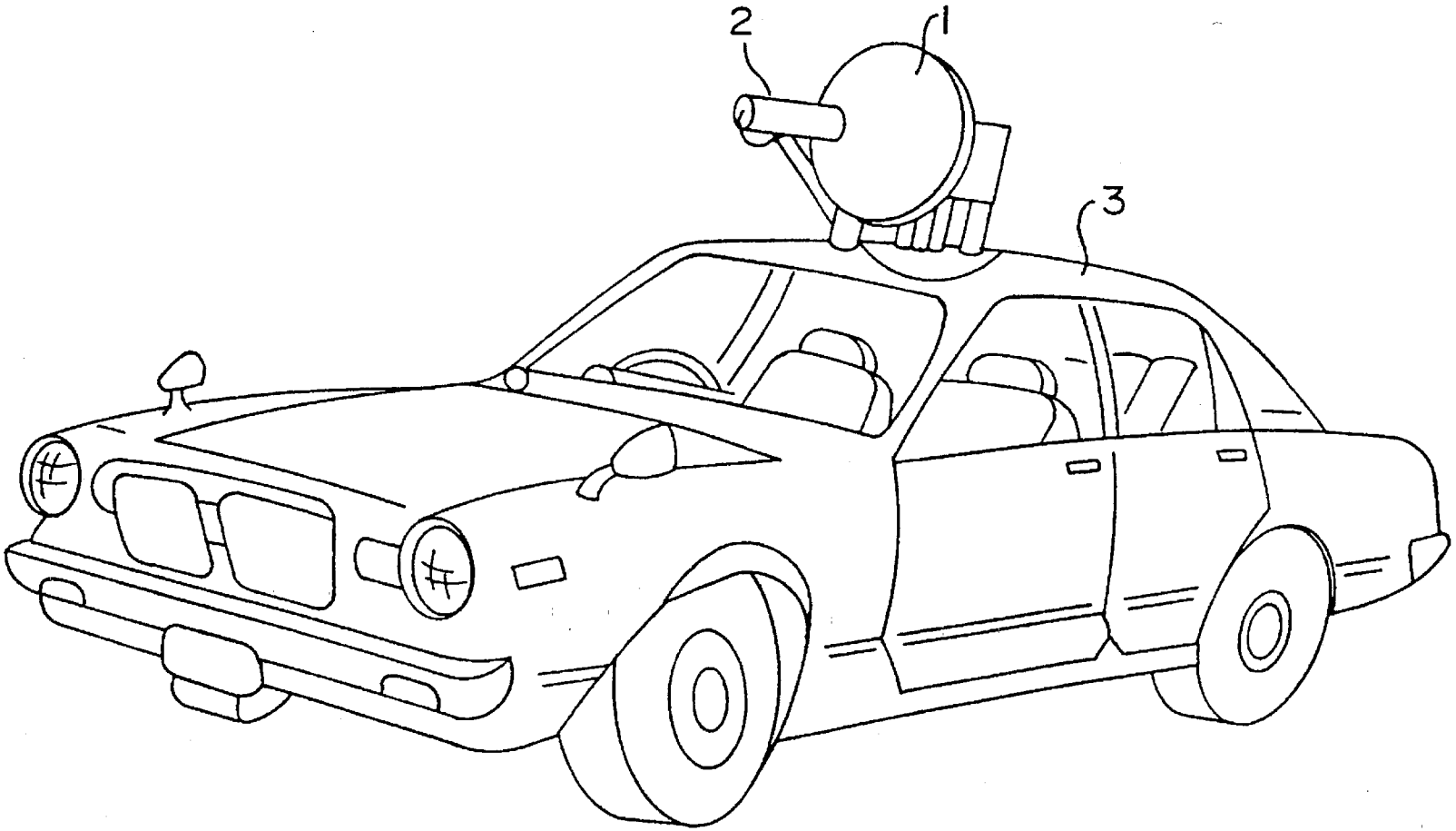
FIG. 1 PRIOR ART
FIG. 1 shows a prior art mobile satellite antenna design.
Figure 2:
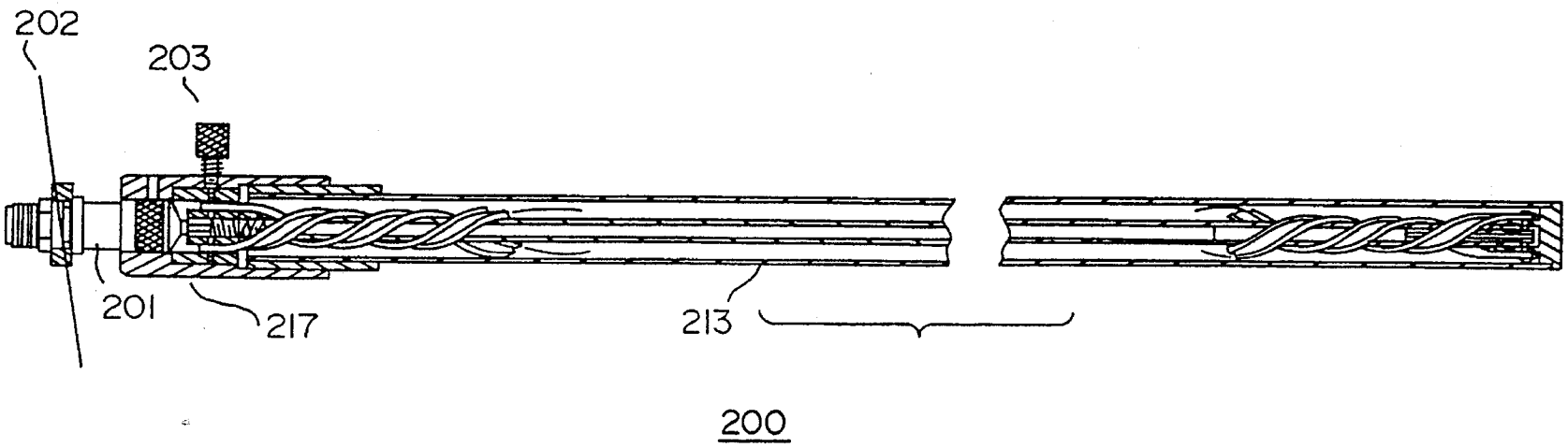
FIG. 2 shows a cross-sectional view of a bifilar helical antenna of the present invention.
Figure 2A:
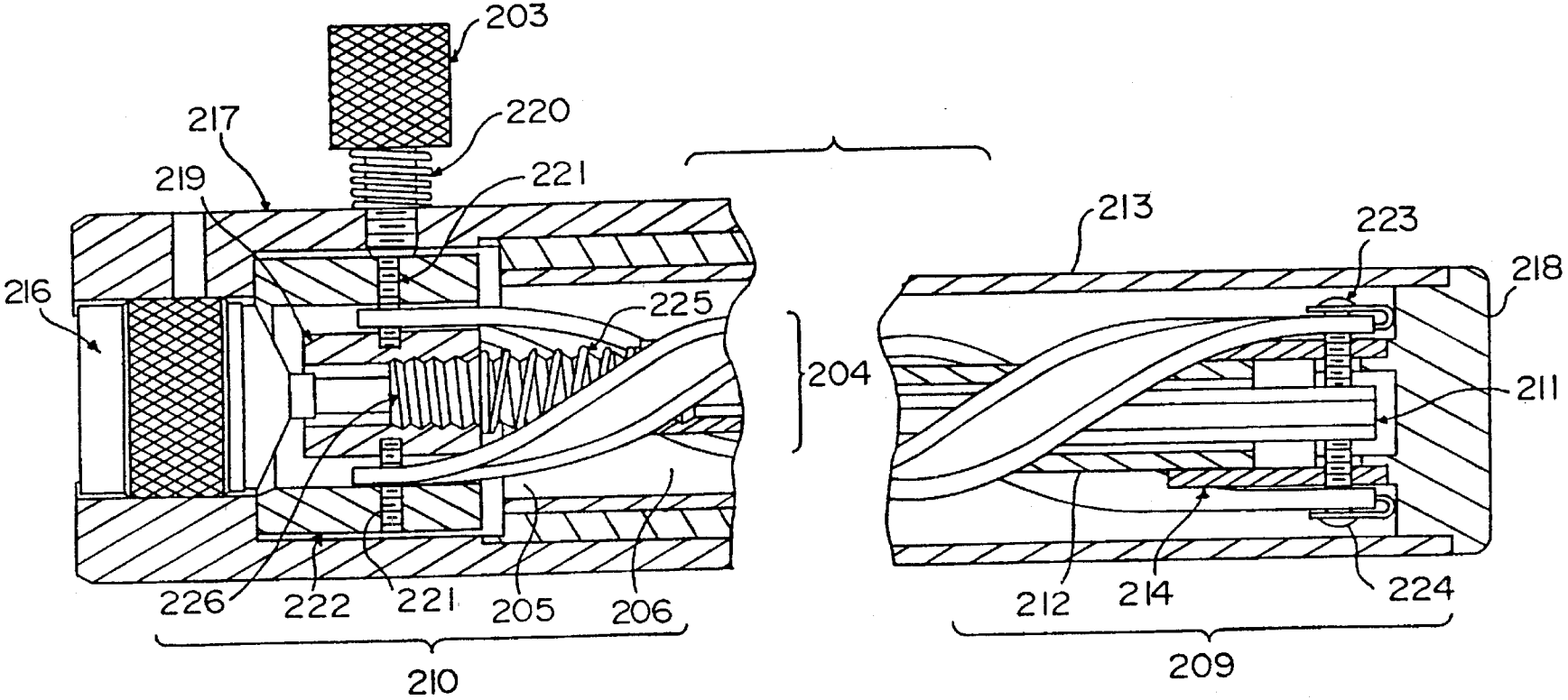
FIG. 2A shows an enlargement showing details of the bifilar helical antenna of FIG. 2.

FIGS. 2 and 2A show a multi-turn bifilar helix antenna (hereinafter "antenna") 200 using a mechanical design which permits the pitch and diameter of helix elements 205 and 206 to be adjustable. This mechanical adjustment elicits an electrical response in the radiation characteristics of antenna 200 which permits beam steering of the radiation pattern in the elevation plane. In the preferred embodiment antenna 200 is capable of scanning its main radiation beam from 20° to 60° in elevation while maintaining relatively omni-directional coverage in azimuth.

A range of 20° to 60° is particularly suitable for use in, the CONUS, as this range of elevation corresponds to the angles of inclination between a geostable satellite and locations throughout the CONUS. Other ranges of angles could, of course, be used if the antenna is to be used in another country or countries. A narrower range could be used in applications where the mobile vehicle is anticipated as having a limited range of travel. A fixed elevation angle could be chosen for stationary antennas or antennas using in local mobile applications. At the other extreme, an adjustment range could be provided from 0° (horizon) to 90° (zenith) to provide global coverage. The preferred range of 20° to 60° is shown here for use in the CONUS and is in no way intended to limit the scope of the invention.

The mast antenna of FIG. 2 is designed to mount to a detachable base 201 located on the vehicle skin (e.g., trunk, fender, roof or the like) 202. Its scanned radiation angle is set manually by the vehicle operator with the relatively simple adjustment of a knurled sleeve 222 at the base 217 of antenna 200.

Bifilar helix 204 comprises two helix elements 205 and 206 separated 180° apart, but sharing a common axis. In the preferred embodiment, helix elements 205 and 206 have conductors made of a highly conductive material, such as copper. Helix elements 205 and 206 serve as the radiating portion of the antenna. Helix 204 has distal end 209 and proximal end 210. In general, the distal end 209 of the vertically mounted antenna 200 is the end which is furthest from the ground plane formed by vehicle skin 202. Antenna 200 is fed at distal end 209 with a balanced assembly comprising coaxial cable section 211 terminating in a balun 214. This distal feed technique is sometimes referred to as the backfire mode.

Helix elements 205 and 206 are formed by being wound around a constant diameter tube to form a uniform helix. The angle of pitch of helix 204 is determined by the number of helix turns for a given axial length. Pitch in unit length is defined as the axial length required for the helix to make one complete turn about its axis. When helix elements 205 and 206 are wound 180° apart as suggested above, a criss-cross effect of the elements is observed when the structure is viewed from the side as is shown in FIGS. 2 and 2A.

The spacing (helix diameter) and angle of pitch of helix 204 determines the polarization and radiation characteristics of antenna 200. A bifilar helix with left-handed helices (ascending counter-clockwise as viewed from the bottom) radiates a right-hand circularly-polarized (RHCP) wave which is relatively omni-directional in azimuth. If the pitch angle and or the diameter of helix 204 is increased from an initial reference point, the radiation in elevation is scanned towards the horizon. In the present invention, the element pitch angle and helix diameter are adjusted by varying the number of helix turns for a fixed axial length.

In one embodiment, helix elements 205 and 206 are made from 300 ohm twin lead line commonly used in FM receivers and some television leads. One of the conducting leads is removed from the polypropylene sheathing of each of helix elements 205 and 206, while the remaining lead serves as the radiating element. Thus, helix elements 205 and 206 each contain only one wire.

Polypropylene was chosen because it readily takes a helix shape when wrapped around a metal tube (not shown) and heated with a hot air gun. Other heating techniques can also be used including heating the metal tube itself. In the embodiment shown in FIGS. 2 and 2A, helical elements 205 and 206 were formed from two 37 inch lengths of 300 Ohm twin lead line suitably modified as discussed above by stripping one of the leads from the sheathing. When wound six and one-half time around a ⅝ inch diameter tube, helical elements 205 and 206 are formed at an axial length of about 31 inches.

Formed helix elements 205 and 206 are placed over a 31 inch long ⅜ inch diameter hollow supporting tube 212 which may be made of any fairly robust insulating material such as phenolic resin. Supporting tube 212 is centrally located within a 32 inch long outer sheath 213 which is one inch in diameter. Outer sheath 213 also may be formed of any robust insulating material such as polycarbonate and serves to provide environmental sealing of the antenna assembly. Coaxial cable 211 is fed through the center of supporting tube 212 and is terminated at the distal end 209 at balun 214. Coaxial cable 211 may be formed from a UT141 semi rigid coaxial line.

Balun 214 comprises a hollow 3/16 inch diameter brass tube with two feed screws 223 and 224 located 180° apart. The wire portions of Helix elements 205 and 206 are secured to the termination of balun 214, one on each side, by feed screws 223 and 224. Proximal end 210 of coaxial line 211 is terminated by connector 216 which may be press fitted into base 217 of antenna 200. Balun 214 serves to maintain a relative phase difference of 180° between the radiating elements for the required frequency bands.

In an alternative embodiment, balun 214 comprises a hollow 3/16 inch diameter slotted brass tube with two slots in the tube located 180° apart. The slots are 0.124 inches wide by 1.85 inches long. The wire portions of Helix elements 205 and 206 are soldered to the termination of balun 214, one on each side, separated by the slots.

Support tube 212 is captured at distal end 209 by end cap 218 set into distal end 209 of outer sheath 213 so as to prevent support tube 212 from rotating. End cap 218 is secured to distal end 209 of outer sheath 213 by glue, screws, threading, press fit, or the like.

Proximal end 210 of support tube 212 is movably attached to inner rotatable sleeve 219 by threaded member 226. Threaded member 226 may be, for example, a 1/4–20 threaded stainless steel sleeve. Spring 225 is installed at the point of rotation between support tube 212 and inner rotatable sleeve 219 to prevent undesired relative movement between inner rotatable sleeve 219 and support tube 212. Spring 225 may be made of, for example, stainless steel. Inner rotatable sleeve 219 is held in place by at two set screws 221 within knurled adjustment outer sleeve 222. Inner sleeve 219 and outer sleeve 222 are located within base 217 which supports outer sleeve 213 and connector 216. The two grounded ends of helix elements 205 and 206 are attached to rotating set screws 221, creating a mechanism for changing helix pitch. Access to knurled outer sleeve 222 is made by machining two window slots (not shown) in the base 217. Base 217, inner sleeve 219 and outer sleeve 221 may be made from any suitable insulating plastic material with requisite strength requirements, such as DELRIN (TM) plastic.

Helix 204, preferably made of polypropylene, has the desirous property of maintaining a uniform pitch along its axial length, even when one end is rotated with respect to the other. By fixing proximal end 209 of helix elements 205 and 206 from rotation to balun 214 and attaching proximal ends 210 of helix elements 205 and 206 to rotatable outer sleeve 222, an elevation steerable antenna with fixed height and adjustable pitch is achieved.

In operation, the operator loosens knurled locking bolt 203 (held firm by spring 220) and twists knurled outer sleeve 222 through the two window slots (not shown) to adjust the axial pitch of antenna 200. In its initial position, helix elements 205 and 206 make approximately six and one-half turns within the axial length of antenna 200. This allows for coverage within 20° above the horizon. In the other extreme, helix elements 205 and 206 make just under ten complete turns, allowing for coverage up to 60° above the horizon. A mechanical limiter (not shown) and elevation angle indicator (not shown) are used to prevent the user from forcing the helix elements beyond their six and one-half and ten turn limits and to simplify the process for optimizing the antenna for elevation coverage. The operator's choice of elevation angle can be determined from the latitude where the vehicle is located, or can be positioned with the aid of an electronic antenna peaking device as discussed below in connection with the second preferred embodiment.

Figure 3:
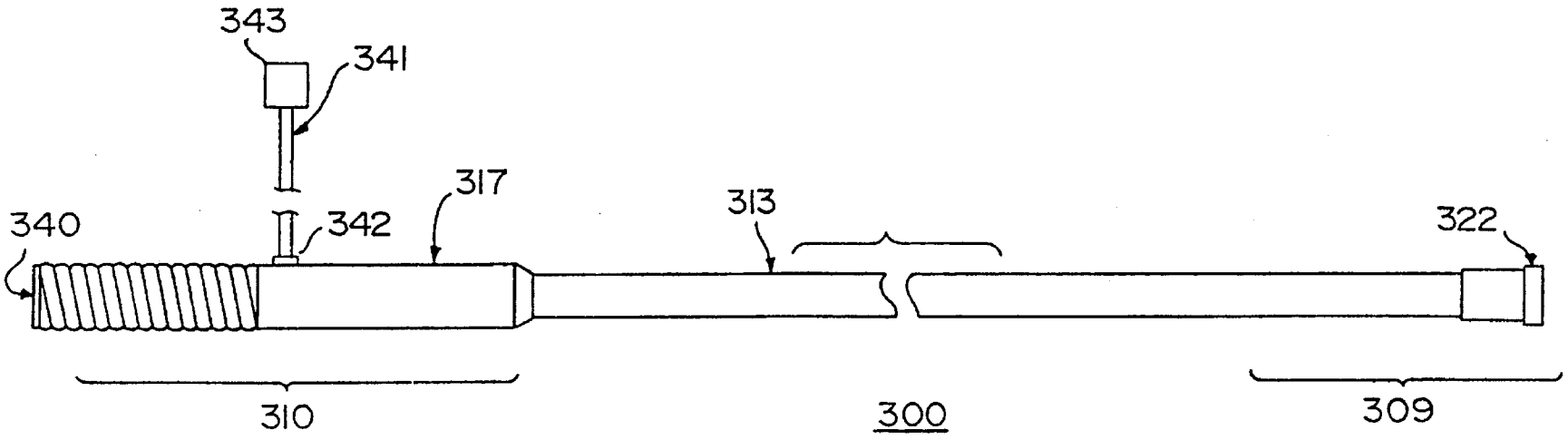
FIG. 3 shows an exterior view of a quadrifilar helical antenna of the present invention.
Figure 3A:
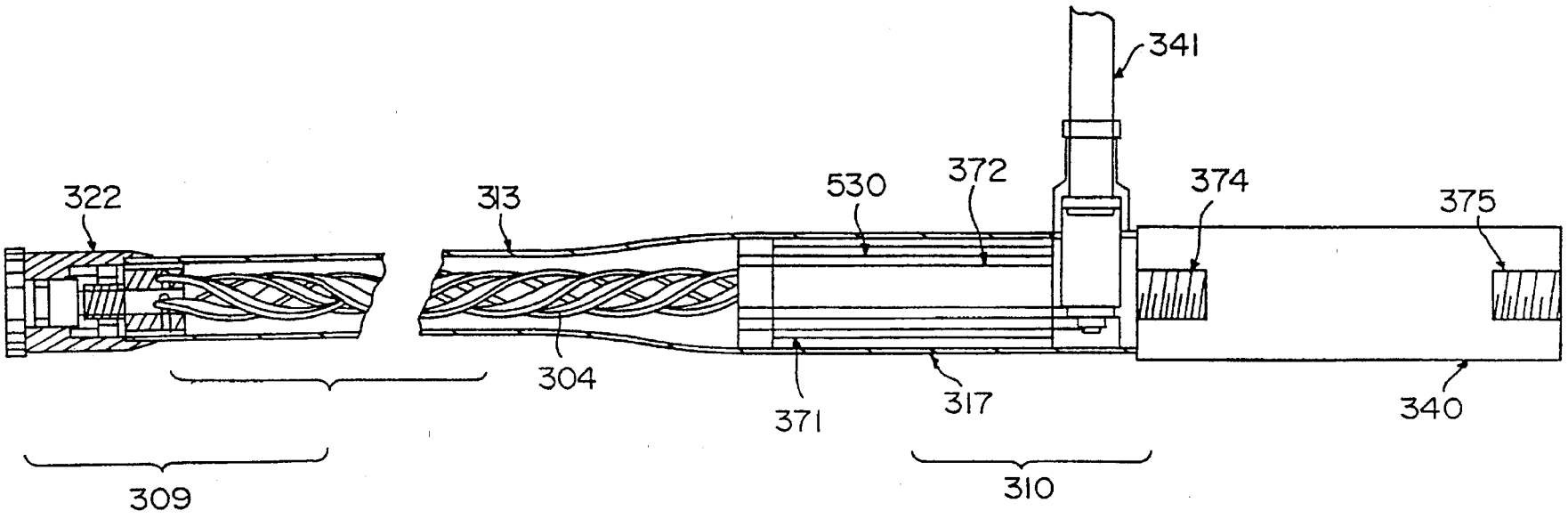
FIG. 3A shows a cross sectional view of the quadrifilar helical antenna of FIG. 3.

FIGS. 3 and 3A show a quadrifilar antenna 300 which is a second preferred embodiment of the present invention. Mast antenna 300 is a multi turn quadrifilar helix antenna fed in phase rotation at its base. In a similar manner to the bifilar antenna 200 discussed above in conjunction with FIGS. 2 and 2A, the antenna 300 of FIG. 3 allows the pitch of the helix elements to be adjusted, causing beam scanning in the elevation plane.

A characteristic exists within this or other antenna designs which can potentially adversely affect its utility as a medium gain omni-directional antenna if not properly accounted for.

As with all travelling wave antennas, the location of the peak radiation beam varies with frequency, giving rise to a phenomenon sometimes called "frequency scanning". Frequency scanning can sometimes result in a reduction of antenna gain between the transmit and receive modes of operation, since the transmit and receive frequencies can differ from each other. For example, in the present invention, the MSAT system for which the antenna of FIG. 3 was designed uses a receive frequency of 1525 to 1559 Mhz and a transmit frequency of 1626.5 to 1660.5 Mhz. This reduction in gain due to frequency scanning is sometimes referred to as "cross-over loss".

In the past, it was proposed that a helix antenna could be modeled as a wave guiding structure capable of supporting several distinct transmission modes each dependent on its particular phase velocity. These relative phase velocities are governed by the physical helix parameters of diameter and pitch, and so the relationship between the guided wavelength and its supporting structure becomes a two-fold problem over that of prior art rectangular waveguide arrays.

Figure 6:
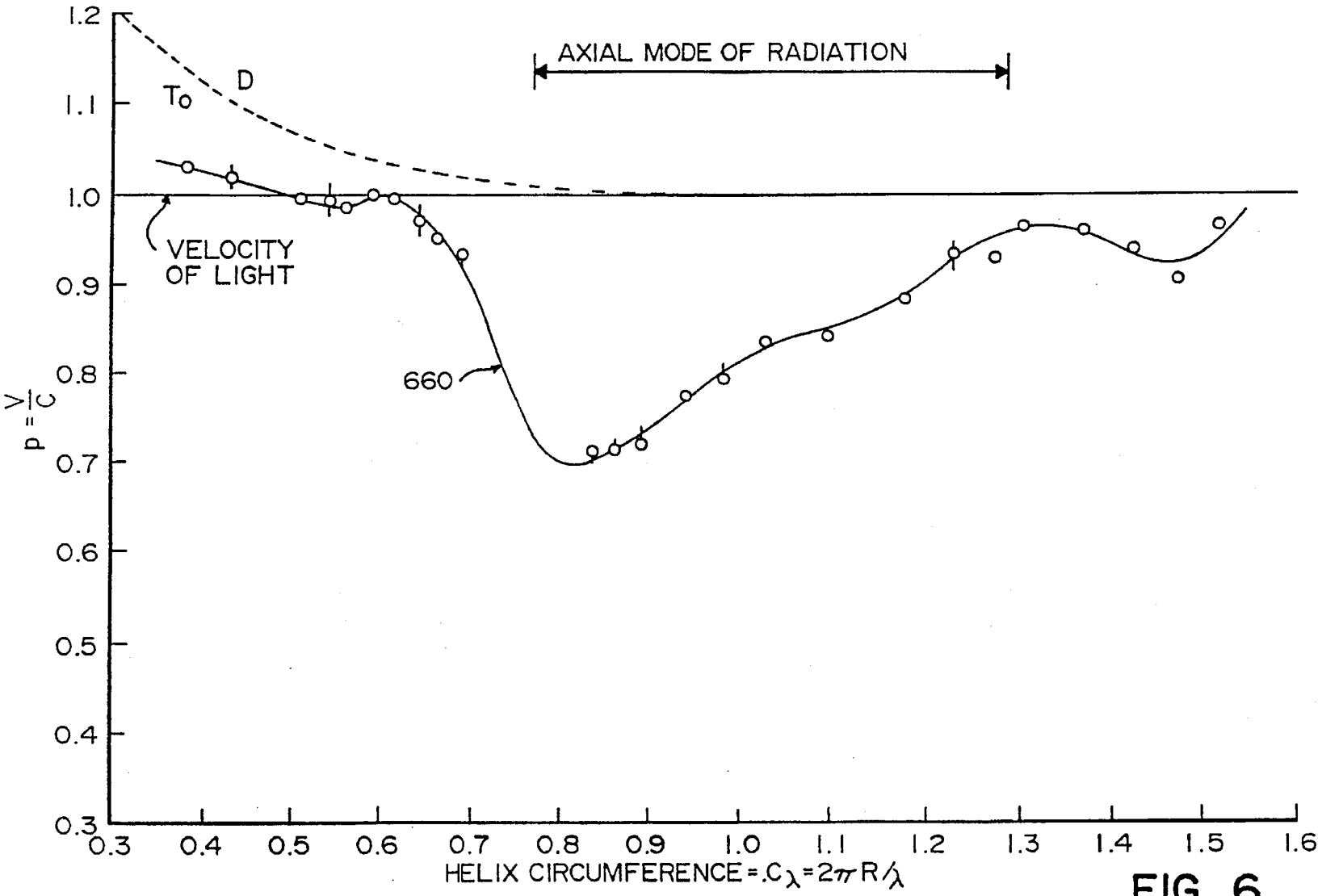
FIG. 6 shows a graph of relative phase velocity as a function of helix circumference used in modeling the present invention.

FIG. 6 plots the relative phase velocity as a function of the helix circumference in freespace wavelengths and illustrates the varying wavelength ratio which gives rise to scanning of the main beam. Segments of measured curve 660 that have a near zero slope (i.e., horizontal) identify a mode of operation in which frequency scanning is at a minimum. Note that these segments near unity correspond to a transition between transmission modes. This correlates with previous observations made on other types of mast antennas which indicated that as their diameter is decreased to a point near the transition between endfire and backfire transmission modes, the frequency scanning behavior decreases.

The key to minimizing scanning effects lies in the a priori knowledge of a relationship between the pertinent helix parameters and the induced phase velocities (or guided wavelengths). The waveguide-fed array is not in itself an adequate model because unlike the helix, its element sources are unique and plainly defined. The quadrifilar helix, being fed in (imbalanced) phase rotation, complicates matters still worse, and very little is offered in the prior art for to aid in providing a solution for the determination of its phase velocity. Thus the present invention encompasses an analytical procedure for providing adequate modeling of a quadrifilar helix antenna.

Computer-based modeling done on the helical antennas of the present invention was provided using the MININEC wire analysis code. This computer code uses a moment method technique to solve for the current distribution on a specified geometry of finite radius wire elements. Once the antenna geometry has been input and evaluated, an output file is generated containing the relative phase and amplitude of the current distribution at periodic points along the antenna structure. From this output file, it is possible to determine the guided wavelength for a given set of physical parameters, thereby resolving the problem of obtaining a controlled model.

From this output file a plot of relative phase velocity versus helix diameter can be generated specifically for the quadrifilar mast. From this plot, it is possible to determine the optimum mast antenna dimensions which will satisfy the goal of minimizing frequency scanning. From this data, it has been determined that the traveling wave increases speed with decreasing diameter corresponding to a mode transition from backfire to endfire. To maintain the necessary beam coverage, however, the helix pitch must also be adjusted. Frequency scanning thus decreases with a corresponding decrease in antenna diameter. From this information, it was determined that an optimal pair of pitch and diameter parameters can be chosen to result in a reduction in frequency scanning.

For the quadrifilar antenna of FIG. 3 and 3A, it was determined that for the 60° limit of elevation, a diameter of 0.40 inches and a pitch of 9 turns over the 30 inch length (pitch=3.35 inches) was optimum. For the 20° limit of elevation, a diameter of 0.50 inches and a pitch of 6 turns over the 30 inch length (pitch=5 inches) was optimum. These dimensions reduced the frequency scanning effect to 4° objective at 20° elevation, 6° objective at 40° elevation, and 9° at 60° elevation. That is to say, that the difference between the elevation of the peak radiation beam in the transmit and received modes was 4°, 6° and 9° for a given elevation setting of 20°, 40° and 60°, respectively. This effectively reduces the frequency scanning effect by at least 2° to 4° over the bifilar antenna 200 of FIGS. 2 and 2A.

As discussed above, nearly equal to the operational performance of the antenna is its appearance to the user and its durability in a vehicular environment. Antenna 300 is thus fitted with a fiberglass radome (outer sheath) 313 to improve appearance and to increase the robustness of the design. A power combiner 530 for the four helical elements 304 of antenna 300 is housed in an enlarged base section 317 of radome 313. A neatly styled elevation adjustment knob assembly 322 is placed at distal end 309 of antenna 300 to adjust the pitch of the four helical elements 304 of antenna 300. The structure of adjustment knob 322 is discussed below in conjunction with FIGS. 4 and 4A.

Radome 313 is constructed from a fiberglass tube with 0.030 inch walls and a 0.625 inch diameter. This reduced diameter improves the appearance of the antenna such that it is nearly indistinguishable from ordinary CB or ham radio antennas currently in use. Of course, materials other than fiberglass may be used, such as polycarbonate or the like so long at the material is relatively stiff, non-conductive, and provides some impact resistance. Fiberglass was chosen here for its relative stiffness, low cost and ability to flex under impact for low clearance hazards.

For the quadrifilar helix antenna 300, an optimum helix diameter was determined (using the procedure discussed above in conjunction with FIG. 5) to be approximately 0.40 inches, which can easily be accommodated in the 0.625 inch diameter radome. Microstrip feeding circuitry, discussed below conjunction with FIG. 5, was designed in a cylindrical shape so as to be incorporated in to the antenna itself. The cylindrical microstrip feeding circuitry, however, requires an increase in diameter of radome 313 from 0.625 inches to 0.75 inches in diameter in enlarged base section 317. Enlarged base section 317 of radome 313 may be, for example, 3.75 inches long to accommodate the feed circuitry. The remaining 0.625 inch diameter portion of radome 313 is approximately 30 inches in length, approximately the same size and shape as existing CB or ham radio antennas.

Figure 5:
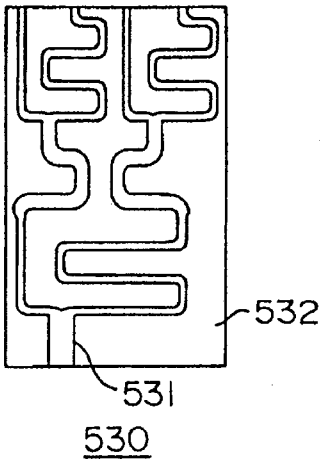
FIG. 5 shows a phased power combiner for use in the quadrifilar helical antenna of the present invention.

FIG. 5 shows the power combiner circuit of the present invention. Power combiner 530 is made from a conductor bonded to a flexible film to form a flexible circuit. In the preferred embodiment, power combiner 530 is etched out of copper 531 on 5 mil thick MYLAR, a thin, strong polyester film film 532. The four helical elements 304 of antenna 300 are fed in quadrature phase rotation through a 4 into 1 power combiner 530 which may be etched on the same sheet of MYLAR as helical elements 304, as will be discussed below in conjunction with FIG. 5A. Power combiner 530 provides the necessary phase rotation to the four helix elements of antenna 300 for circular polarization. Power combiner 530 forms a covered microstrip transmission line medium when "sandwiched" between two polypropylene tube sections 371 and 372 and then slid over a brass rod (not shown) which acts both as a transmission line ground plane and mounting base. In one embodiment, Power combiner 530 is sandwiched between two tubular sections of 0.063 inch wall polypropylene 371 and 372 which act as microstrip superand substrates, respectively. This assembly is then slid over a brass rod (not shown) which acts as a ground plane and completes the circuit. One end of this brass rod extends beyond the end of radome 313 and connects to mounting spring 340 for mounting purposes.

A hole (not shown) is drilled through the brass rod (not shown) perpendicular to its line of axis and permits access for connecting cable 341 which has its center input soldered to the input port of power combiner 530. The outer conductor (not shown) of connecting cable line 341 is soldered to a ferrule (not shown) which retains a securing nut, thereby securing and providing electrical contact between the brass rod (not shown) and the outer conductor (not shown). Connecting cable 341 exits antenna 300 at the bottom end of enlarged base section 317 through a grommet seal 342 and serves as a feed line. Connecting cable 341 may be constructed, for example, of a twelve inch length of RG-304/U cable terminated in a TNC connector 343.

Figure 5A:
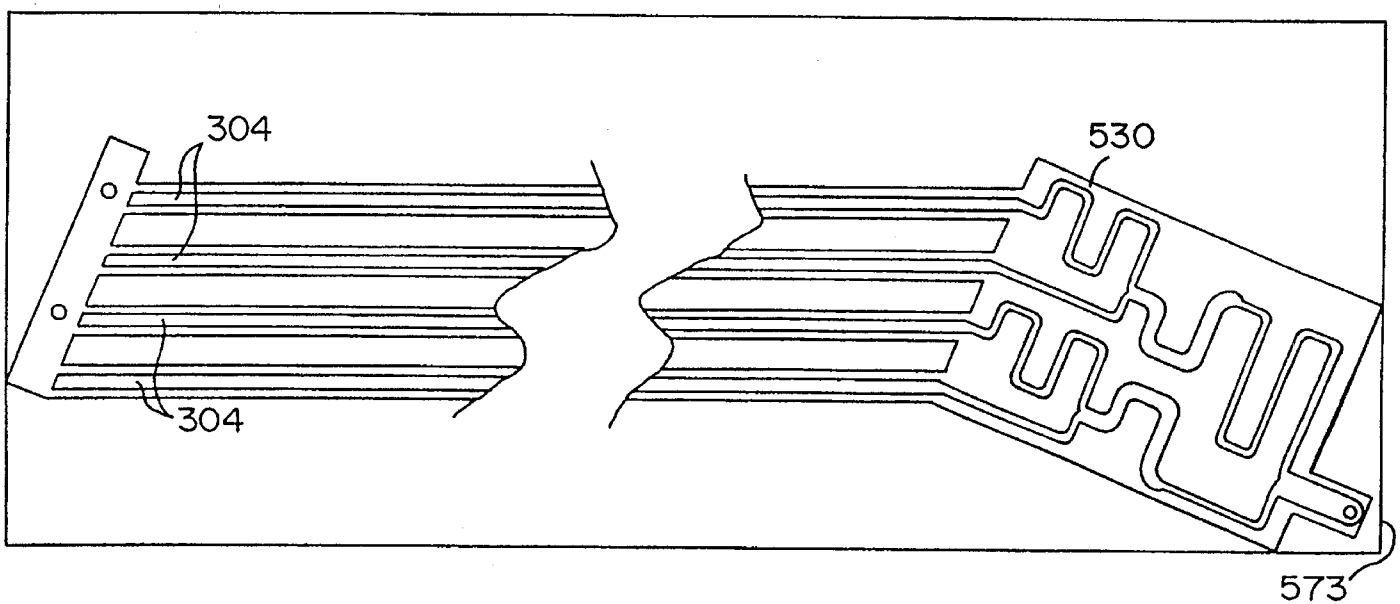
FIG. 5A shows a flexible circuit layout for a combined phased power combiner and quadrifilar helical antenna.

The four helical elements 304 may be made of polypropylene 300 Ohm twin lead antenna cable as discussed above in conjunction with FIGS. 2 and 2A. However, in the preferred embodiment, these elements can be formed from copper etched on a MYLAR film as shown in FIG. 5A. One advantage of making helical elements 304 using copper on MYLAR film is that since the power combiner 530 is also formed on a MYLAR film, the two can be combined as a single circuit, thus eliminating many soldering and assembly operations and reducing cost. FIG. 5A shows a technique for laying out both power combiner 530 and helical elements 304 onto one sheet of MYLAR film 573. Mylar film 573 can then be cut, for example, through a die cutting process, to produce the assembly of power combiner 530 and four helical elements 304. The MYLAR film has the advantage of not requiring thermoforming. Mylar film based helical elements 304, if cut in the proper shape, will readily assume and maintain a helical configuration without thermoforming. Of course, other materials other than MYLAR may be used so long as the material is suitably flexible to allow the helical elements 304 to be bent in a helical shape and that the material successfully bonds with the circuit elements. Similarly, although copper is shown here as comprising helical element 304, other conductive materials may also be used.

To improve the robustness of the design, spring base 340 is provided to absorb shock on impact between the antenna and low clearance objects (e.g., garage doors, tree limbs and the like). Spring base 340 may be one inch diameter and three inches in length. On both ends of the spring base 340 are tapped inserts 374 and 375. The brass rod (not shown) discussed above, extending from the base section 317 of radome 313 is threaded at one end of spring base 340 into tapped insert 374. A universal ball mount (not shown) is threaded into the other end of spring base 340 into tapped insert 375. The bottom of ballmount (not shown) is tapped to accept a single mounting bolt (not shown) which has its head secured beneath the mounting surface of the vehicle. In the preferred embodiment, all threaded mounts are standardized to a 5/16–18 thread.

As in antenna 200 of FIGS. 2 and 2A, a knurled knob 322 is provided on antenna 300 to provide adjustment of the antenna beam in the elevation plane. In the antenna 300 of FIG. 3, however, this knob is located at the distal end 309 of antenna 300. Locating adjustment knob 322 at distal end 309 of antenna 300 improves the overall appearance of antenna 300, simplifies construction, and discourages unnecessary tampering with the elevation adjustment of antenna 300.

Figure 4:
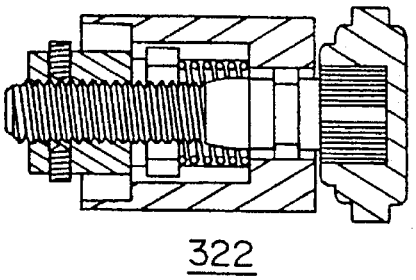
FIG. 4 shows a cross-sectional view of the adjustment mechanism for the helix elements.
Figure 4A:
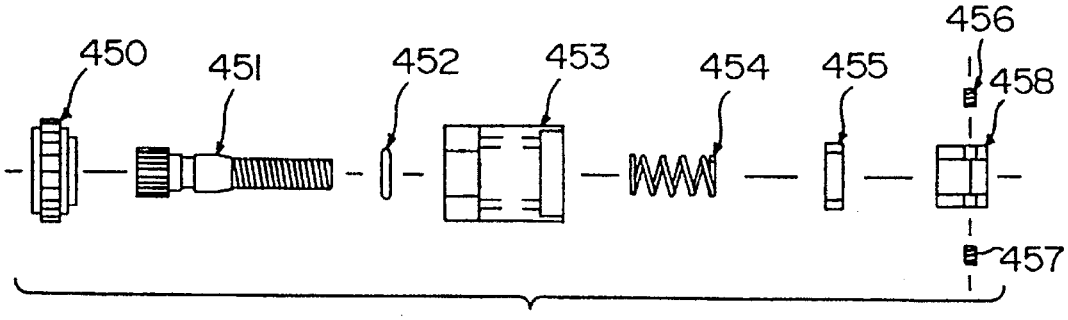
FIG. 4A shows an exploded view of the adjustment mechanism of FIG. 4.
Figure 4B:
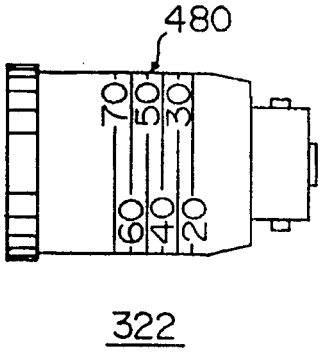
FIG. 4B shows an exterior view of one embodiment of the adjustment mechanism of FIG. 4.

Adjustment knob 322 is shown in cross-sectional detail in FIGS. 4 and 4A and in exterior detail in FIG. 4B. Adjustment knob 322 is designed as a separate piece part for simple assembly to radome tube 313 and helix elements 304. A moving travel limiter may be used as a vernier for fine peak adjustment as will be discussed below in conjunction with FIG. 4B.

Referring now to FIGS. 4 and 4A, adjustment knob 322 comprises knurled knob 450 which is press fit onto a splined end of threaded shaft 451. Threaded shaft 451 may be formed from a commercially available socket head cap screw. Threaded shaft 451 passes through weather sealing O-ring 452 into knob housing 453. Adjustment housing 453 is fixedly attached to distal end 309 of radome 313 by the use of screws, glue or the like. Threaded shaft 451 passes through compression spring 454 and travel limit nut 455 and connects threadably to mounting/retaining ring 458. Threaded shaft 451 is secured to mounting/retaining ring 458 and the helical elements 304 of antenna 300 by set screws 456 and 457.

In operation, when knurled knob 450 is turned, mounting/retaining ring 458 turns as well, altering the pitch of the helical elements 304 in a similar manner as discussed above in conjunction with FIGS. 2 and 2A. Travel limit nut 455 is slotted (not shown) and rides on corresponding ridges (not shown) in knob housing 453. Pressure between compressing spring 454, travel limit nut 455, and knob housing 453, prevents threaded shaft 451 from turning on its own due to vibration or the like. In addition, travel limit nut 455 limits the amount of travel of the mounting/retaining ring 458. When knurled knob 450 is turned to one extreme, travel limit nut 455 will seat against compressed compression spring 454, preventing any further movement. When knurled knob 450 is turned in the other extreme, travel limit nut 455 will seat against mounting/retaining ring 458, also preventing any further movement. Thus, travel limit ring 455 prevents the user from over adjusting antenna 300 and possibly damaging the MYLAR based helixes 304.

Antenna 300 can be adjusted by means of indicia marked on the outside of knob housing 453, indicating relative angles of elevation as is shown in FIG. 4B. Knob housing 453 can be made of a clear plastic such as acrylic plastic, so that the position of travel limit nut 455 is easily visible to the user. Alternately other techniques can be used, such as modifying travel limit nut 455 to include an indicator or pointer to extend through a slot in knob housing 453. The use of clear plastic, however, allows the unit to remain weather tight.

In use, the antenna is designed to be adjusted by the user, for example, a truck driver or the like. Relative latitude and angle of elevation information can be converted to a simple table for use by the user, for example, listing cities or States, and the corresponding desired elevation setting for the antenna for those cities and States. By turning knurled knob 450 to adjust the antenna, a rough adjustment can be made which in most instances should be sufficient to properly adjust the angle of elevation so that the conical shaped beam of the antenna will intercept the geostable orbit of the satellite.

In addition, an electronic antenna peaking circuit (not shown) can be provided to provide an audible feedback to the user when the antenna had been properly adjusted. Such a peaking circuit can be incorporated into the transceiver circuitry (not shown). When the antenna peaking circuit is activated, the user then adjusts the antenna until a particular tone or signal is heard, indicating the adjustment of the antenna is at optimum. A speaker or earphones can be provided to that the user can hear the audible tone or tones. Alternatively, a meter or other type of visual display can be used to indicate antenna signal strength or some other indication signal for purposes of optimizing antenna adjustment.

Further, it may be desirable to use a scheme for optimizing antenna adjustment which takes into account the frequency scanning effect (albeit reduced) present in the antenna. In operation, the user rotates knurled knob 450 counterclockwise to its limit (i.e., the "low" or 20° limit). This will set the elevation of the main radiation beam of antenna 300 to its lower limit of approximately 20°. The user then hits a "RESET" button (not shown) on the MSAT transceiver (not shown). The user then carefully rotates knurled knob 450 clockwise to its other limit (i.e., the "high" or 60° limit), slowly scanning the main radiation beam of antenna 300 upwards for 20° to 60°. The MSAT transceiver (not shown) measured the signal strength of the received signal and records the maximum values of the received signal.

The user then slowly rotates knurled knob 450 counterclockwise until a "beep" is heard from MSAT transceiver (not shown) through a speaker (not shown) or headphones (not shown). Again, as discussed above, a visual display could also be used (not shown). The "beep" indicates the event when the received signal changes to a value 1 Db less than the maximum signal value which was recorded during the upwards scan of the beam as discussed above. This peaking feature may be implemented by a sample-and-hold circuit (not shown) in the MSAT terminal with a resolution of 1 dB and an annunciator on the handset, or any other equivalent technique.

This strategy will permit near optimum beam steering. It will align the satellite onto the lower elevation side of the receive beam. Since the transmit beam of antenna 300 is always lower in elevation (for the given frequency values used) than the receive beam, the transmit beam will always be close to optimum. With this pointing strategy, the approximate angular misalignment from perfect received beam conditions is about 6 degrees. Thus, the actual pointing is within about 2 degrees of the crossover point between transmit and receive beams. By avoiding the condition where the antenna was peaked to the upper side of the receive beam, substantial improvements in beam pointing are afforded.

Of course, many other modifications are possible of the present invention without departing from the scope or spirit of the present invention. For example, while the antennas of FIGS. 2, 2A, 3 and 3A are discussed as being approximately 30 inches or more in length, other lengths could be used with suitable results. Since printed circuit technology is used in conjunction with the antenna of FIG. 3, these elements could be easily modified by top loading them with reactive elements. In the bifilar antenna, for example, shielding a portion of the structure opposite the feed end has little effect on antenna gain. The mast acts as a helical waveguide, with one section radiating and another section inducing that radiation, like a reactive element storing energy. The length of the non-radiating section could be easily reduced without affecting the travelling current on the rest of the structure. A reduced height antenna mast would provide an even more aesthetically pleasing appearance, reduce wind resistance and improve the robustness of the design by reducing the likelihood of low clearance collisions.

In addition, as discussed above, it had been discovered in testing that the bifilar helical antenna of the present invention, shielding a portion of the structure opposite the feed end has little effect on antenna gain. This confirms the premise that radiation currents are practically non-existent along the last few turns of the antenna. Experiments have shown that shielding the last eight inches (or more) of the antenna (as measured from the base) improved the axial ratio with little or no degradation in gain. Inserting the antenna through the ground plane to various positions along the shielded section improved the axial ratio further. Thus, the antennas of the present invention could be suitably modified to be mounted below the vehicle skin (e.g., eight inches or more) with only the remaining portion of the antenna showing. This mounting technique not only improves the axial ratio, but reduces overall mast height, improving the aesthetic appearance and reducing clearance hazards. This technique would be especially useful in manufacturing a retractable version of the antenna of the present invention.

Further, although the helical antenna of the present invention is disclosed as having two or four helical elements, other number of elements could successfully be used in other antenna configurations. In addition, although the helical elements are shown here as being equilaterally spaced about a central axis (180° for the two element antenna, and 90° for the four element antenna), other spacing arrangements could also be used, so long as the elements are symmetrically arranged about the axis.

It should also be noted that although the elevation adjusting knob of the present invention adjusts both the axial pitch and radial diameter of the helixes, the antenna could be configured to adjust either one of these variables independently of the other.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof,

I claim:

1. A method of manufacturing a helical antenna comprising the steps of:

cutting a section of flexible twin conductor antenna lead to a predetermined length, said twin conductor antenna lead having a first conductor and a second conductor surrounded by an insulating sheath, wrapping said cut section of flexible twin antenna lead in a helix shape about a form of a predetermined diameter, to produce a wrapped lead, and heating said wrapped lead to produced a thermoformed lead.

2. The method of claim 1 further comprising the step of:

removing said first conductor from said insulating sheath of said flexible twin conductor antenna lead, leaving the other conductor in place, after said cutting step and prior to said wrapping step.

3. The method of claim 1 wherein said insulating sheath of said flexible twin conductor antenna lead is formed of polypropylene.

4. A method of manufacturing a helical antenna comprising the steps of:

etching at least one conductive trace from a sheet of conductor bonded to a flexible film, cutting said flexible film to a size substantially the same as said at least one conductive trace to produce at least one flexible antenna element, and wrapping said at least one flexible antenna element in a helical form to produce at least one flexible helical antenna element.

5. The method of claim 4 further comprising the steps of:

forming a power combining circuit on said flexible film, said power combining circuit being coupled to one end of said at least one flexible antenna element, and wrapping said power combining circuit in a tubular form prior to wrapping said at least one flexible antenna element in a helical form.

6. The method of claim 5, further comprising the steps of:

sliding said power combining circuit wrapped in tubular form, over a tube shaped substrate, and sliding a tube shaped superstrate over said power combining circuit wrapped in tubular form.

7. The method of claim 6, further comprising the steps of:

sliding said tube shaped substrate over a tube shaped ground element, securing said tube shaped ground element to a base for mounting said antenna, securing one end of a tube shaped support tube to said base, and coupling an other end of said at least one flexible helical antenna element to said an other end of said tube shaped support to produce an antenna assembly.

8. The method of claim 7 further comprising the step of: securing a radome to cover said antenna assembly.

9. The method of claim 7 wherein said coupling step further comprises the steps of:

securing said other end of said at least one flexible helical element to an adjustment means for adjusting the axial pitch of said helical antenna, and securing said adjustment means to said tubular support element.

10. A method for aiming a helical antenna comprising at least one flexible helical element while compensating for frequency scanning effects comprising the steps of:

adjusting the pitch of said at least one flexible helical element to a predetermined lower limit so as to steer a receive beam of said helical antenna to a predetermined lower elevation, adjusting the pitch of said at least one flexible helical element from said predetermined lower limit to a predetermined higher limit so as to scan said a receive beam of said helical antenna to from said predetermined lower elevation to a predetermined higher elevation, measuring the signal strength of a signal received by said helical antenna during the second adjusting step, recording the maximum value of said received signal measured during said second adjusting step, adjusting the pitch of said at least one flexible helical element from said predetermined higher limit towards a predetermined lower limit so as to scan said a receive beam of said helical antenna to from said predetermined higher elevation towards a predetermined lower elevation, measuring the signal strength of a signal received by said helical antenna during the third adjusting step, generating an output signal indicative of the event when the received signal changes to a value 1 Db less than the maximum signal value recorded during the second adjusting step.

11. The method of claim 10 wherein said recording step is implemented by a sample-and-hold circuit.

12. The method of claim 10 wherein said generating step comprises the step of:

generating an audio signal indicative of the event when the received signal changes to a value 1 Db less than the maximum signal value recorded during the second adjusting step.

13. The method of claim 10 wherein said generating step comprises the step of:

generating a visual signal indicative of the event when the received signal changes to a value 1 Db less than the maximum signal value recorded during the second adjusting step.

14. A method of manufacturing a helical antenna comprising the steps of:

cutting a section of flexible twin conductor antenna lead to a predetermined length, wrapping said cut section of flexible twin antenna lead in a helix shape to produce a wrapped lead, and heating said wrapped lead to produced a thermoformed lead.

15. A method of manufacturing a helical antenna comprising the steps of:

etching at least one conductive trace from a sheet of conductor bonded to a flexible film, cutting said flexible film to produce at least one flexible antenna element, and wrapping said at least one flexible antenna element in a helical form to produce at least one flexible helical antenna element.

16. A method for aiming a helical antenna comprising at least one flexible helical element while compensating for frequency scanning effects, comprising the steps of:

adjusting the pitch of said at least one flexible helical element to a first predetermined lower limit representing a first predetermined lower elevation, adjusting the pitch of said at least one flexible helical element from said first predetermined lower limit to a predetermined higher limit representing a predetermined higher elevation, measuring a first signal strength of a first signal received by said helical antenna during the second adjusting step, adjusting the pitch of said at least one flexible helical element from said predetermined higher limit towards a second predetermined lower limit representing a second predetermined lower elevation, measuring a second signal strength of a second signal received by said helical antenna during the third adjusting step, generating an output signal indicative of the event when the second signal strength changes to a predetermined value less than a predetermined maximum signal value.

17. A method of manufacturing a helical antenna, comprising the steps of:

etching at least one conductive trace from a sheet of conductor bonded to a flexible film;

cutting said flexible film to a size substantially the same as said at least one conductive trace to produce at least one flexible antenna element; and wrapping said at least one flexible antenna element in a helical form about a form of a predetermined diameter, to produce at least one flexible helical antenna element.

18. A method of claim 17, further comprising the steps of:

forming a power combining circuit on said flexible film, said power combining circuit being coupled to one end of said at least one flexible antenna element; and wrapping said power combining circuit in a tubular form about a form of a predetermined diameter, prior to wrapping said at least one flexible antenna element in a helical form.

19. The method of claim 18, further comprising the steps of:

sliding said power combining circuit wrapped in tubular form, over a tube shaped substrate; and sliding a tube shaped substrate over said power combining circuit wrapped in tubular form.

20. The method of claim 19, further comprising the steps of:

sliding said tube shaped substrate over a tube shaped ground element;

securing said tube shaped ground element to a base for mounting said antenna;

securing one end of a tube shaped support tube to said base; and coupling an other end of said at least one flexible helical antenna element to said an other end of said tube shaped support to produce an antenna assembly.

21. The method of claim 20, further comprising the step of securing a radome to cover said antenna assembly.

22. The method of claim 20, wherein said coupling step further comprises the steps of:

securing said other end of said at least one flexible helical element to an adjustment means for adjusting the axial pitch of said helical antenna; and securing said adjustment means to said tubular support element.

23. A method of manufacturing a helical antenna comprising the steps of:

cutting a section of flexible twin conductor antenna lead to a predetermined length;

wrapping said cut section of flexible twin antenna lead in a helix shape about a form of predetermined diameter, to produce a wrapped lead; and heating said wrapped lead to produce a thermoformed lead.

24. A method of manufacturing a helical antenna comprising the steps of:

etching at least one conductive trace from a sheet of conductor bonded to a flexible film;

cutting said flexible film to produce at least one flexible antenna element; and wrapping said at least one flexible antenna element in a helical form about a form of predetermined diameter, to produce at least one flexible helical antenna element.

* * * * *